US010099480B2

(12) United States Patent
Harvey

(10) Patent No.: US 10,099,480 B2
(45) Date of Patent: Oct. 16, 2018

(54) FLUID SUPPLY DEVICE, SEPTUM DEVICE USABLE WITH FLUID SUPPLY DEVICE AND METHOD THEREOF

(71) Applicant: Hewlett-Packard Development Company, L.P., Houston, TX (US)

(72) Inventor: David C. Harvey, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/649,346

(22) Filed: Jul. 13, 2017

(65) Prior Publication Data

US 2017/0305161 A1 Oct. 26, 2017

Related U.S. Application Data

(63) Continuation of application No. 14/125,656, filed as application No. PCT/US2011/045332 on Jul. 26, 2011, now Pat. No. 9,738,078.

(51) Int. Cl.
*B41J 2/175* (2006.01)

(52) U.S. Cl.
CPC ..... *B41J 2/175* (2013.01); *B41J 2/17523* (2013.01); *Y10T 29/49826* (2015.01)

(58) Field of Classification Search
CPC ..... B41J 2/17523; B41J 2/175
See application file for complete search history.

(56) References Cited

U.S. PATENT DOCUMENTS 6,015,209 A 1/2000 Barinaga et al.
6,130,695 A 10/2000 Childers et al.
6,511,166 B2 1/2003 Smith et al.
6,682,184 B2 1/2004 Anderson et al.
6,692,118 B2 2/2004 Michele et al.
6,702,434 B2 3/2004 Barinaga et al.
6,739,709 B2 5/2004 Nip
7,533,976 B2 5/2009 Ogle et al.
(Continued)

FOREIGN PATENT DOCUMENTS

CN 1179385 4/1998
CN 1393342 1/2003
(Continued)

OTHER PUBLICATIONS

International Searching Authority, "International Search Report and Written Opinion," issued in connection with Application No. PCT/US2011/045332, dated Apr. 17, 2012, 13 pages.
(Continued)

*Primary Examiner* — Bradley Thies
(74) *Attorney, Agent, or Firm* — Hanley Flight & Zimmerman LLC

(57) ABSTRACT

A septum device usable with a fluid interconnect unit of a fluid supply device is disclosed. An example septum for use with a fluid supply device, the septum includes a body defining an interior aperture, the body, including: an exterior surface defining a groove to receive a locking member of the fluid supply device when the septum is inserted into the fluid supply device; and a protrusion extending into the interior aperture, the protrusion to rotate at least a portion of the exterior surface toward the locking member in response to an extraction member entering the aperture.

21 Claims, 7 Drawing Sheets

(56) References Cited

U.S. PATENT DOCUMENTS

| | | | | |
|---|---|---|---|---|
| 2002/0084596 | A1 | 7/2002 | Michele et al. | |
| 2003/0202058 | A1* | 10/2003 | Barinaga | B41J 2/17523 347/85 |
| 2005/0146570 | A1 | 7/2005 | Hilton et al. | |
| 2006/0246760 | A1 | 11/2006 | Ogle et al. | |
| 2008/0316249 | A1 | 12/2008 | Aoki et al. | |
| 2010/0231664 | A1* | 9/2010 | Steinmetz | B41J 2/175 347/86 |
| 2014/0152744 | A1 | 6/2014 | Harvey | |

FOREIGN PATENT DOCUMENTS

| | | |
|---|---|---|
| CN | 2544940 | 4/2003 |
| CN | 1419497 | 5/2003 |
| CN | 2553998 | 6/2003 |
| CN | 1736719 | 2/2006 |
| EP | 1221376 | 7/2002 |

OTHER PUBLICATIONS

United States Patent and Trademark Office, "Notice of Allowance," issued in connection with U.S. Appl. No. 14/125,656, dated Apr. 18, 2017, 15 pages.

United States Patent and Trademark Office, "Final Office Action," issued in connection with U.S. Appl. No. 14/125,656, dated Feb. 3, 2017, 9 pages.

United States Patent and Trademark Office, "Non-final Office Action," issued in connection with U.S. Appl. No. 14/125,656, dated Nov. 18, 2016, 16 pages.

United States Patent and Trademark Office, "Final Office Action," issued in connection with U.S. Appl. No. 14/125,656, dated Jul. 12, 2016, 17 pages.

United States Patent and Trademark Office, "Non-final Office Action," issued in connection with U.S. Appl. No. 14/125,656, dated Mar. 1, 2016, 23 pages.

United States Patent and Trademark Office, "Final Office Action," issued in connection with U.S. Appl. No. 14/125,656, dated Oct. 15, 2015, 21 pages.

United States Patent and Trademark Office, "Non-final Office Action," issued in connection with U.S. Appl. No. 14/125,656, dated Jun. 12, 2015, 17 pages.

United States Patent and Trademark Office, "Final Office Action," issued in connection with U.S. Appl. No. 14/125,656, dated Feb. 24, 2015, 19 pages.

United States Patent and Trademark Office, "Non-final Office Action," issued in connection with U.S. Appl. No. 14/125,656, dated Oct. 20, 2014, 22 pages.

* cited by examiner

FLUID SUPPLY DEVICE, SEPTUM DEVICE USABLE WITH FLUID SUPPLY DEVICE AND METHOD THEREOF

RELATED APPLICATION

This patent arises from a continuation of U.S. patent application Ser. No. 14/125,656, filed Dec. 12, 2013, which arises from a national stage of International Patent Application No. PCT/US2011/045332, filed Jul. 26, 2011. Priority is claimed to U.S. patent application Ser. No. 14/125,656 and International Patent Application No. PCT/US2011/045332. U.S. patent application Ser. No. 14/125,656 and International Patent Application No. PCT/US2011/045332 are hereby incorporated herein by reference in their entireties.

BACKGROUND

Septum devices are used in fluid supply devices. Septum devices enable fluid supply devices to engage with image forming apparatuses to supply fluid from the fluid supply device to the image forming apparatus.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Septum devices are used in fluid supply devices such as ink cartridges. Septum devices enable fluid supply devices to engage with image forming apparatuses through a fluid extraction member to supply fluid such as ink from the fluid supply device to the image forming apparatus. Generally, septum devices use secondary tooling and/or require significant manual force to be inserted and fixed in the fluid interconnect unit of the fluid supply device and establish seals therewith. Seals are established by the interaction of the septum device and/or portions thereof with the fluid interconnect unit and a removably inserted fluid extraction member of the image forming apparatus into the septum device.

In examples, a septum device usable with a fluid interconnect unit of a fluid supply device includes, amongst other things, a resilient main body to be inserted into the fluid interconnect unit of the fluid supply device. The resilient main body includes an interior septum surface forming a longitudinal opening to removably receive a fluid extraction member and an exterior septum surface. The resiliency of the resilient main body, range of movement of the exterior engagement members and reduced surface area of the exterior septum surface against the fluid interconnect unit enable ease of manual installation of the septum device to be press-fit into the fluid interconnect unit of the fluid supply device. Further, the interior septum surface includes interior engagement members to engage the removably inserted fluid extraction member and the exterior septum surface includes exterior engagement members to engage an interior interconnect surface of the fluid interconnect unit. Forces established by the engagement of the exterior engagement members with the fluid interconnect unit and the interior engagement members with the fluid extraction member establish and reinforce fluid-tight seals therewith.

Figure 1:
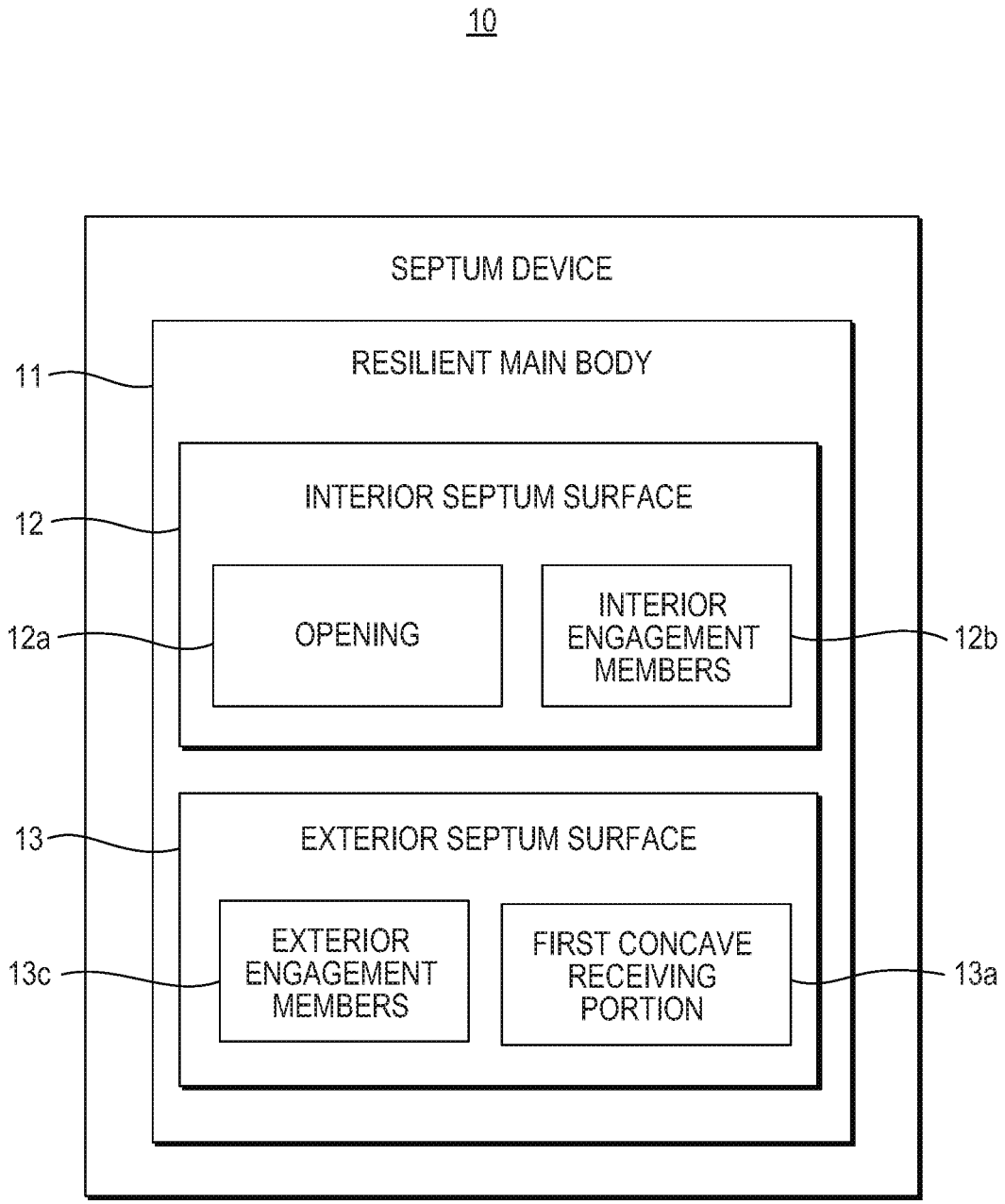
FIG. 1 is a block diagram illustrating a septum device according to an example.
Figure 2A:
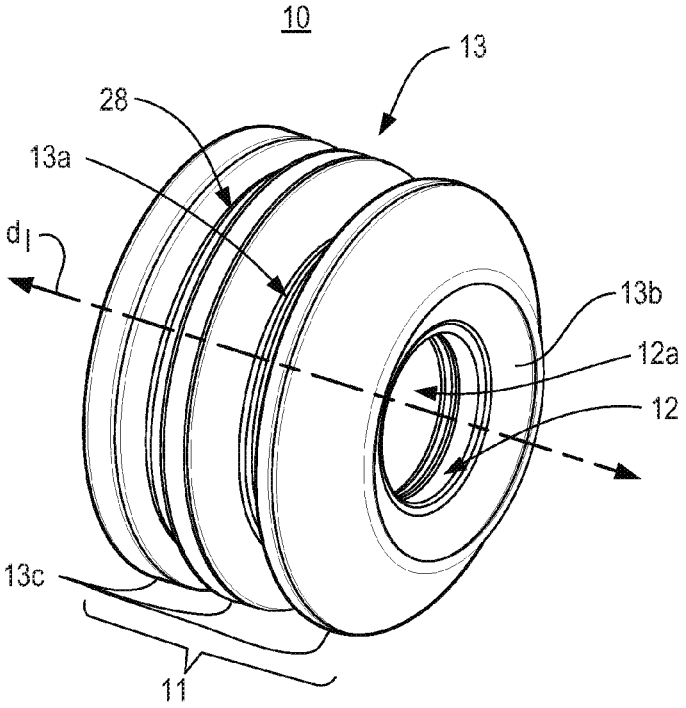
FIG. 2A is a perspective view of the septum device of FIG. 1 in an uninstalled state according to an example.
Figure 2B:
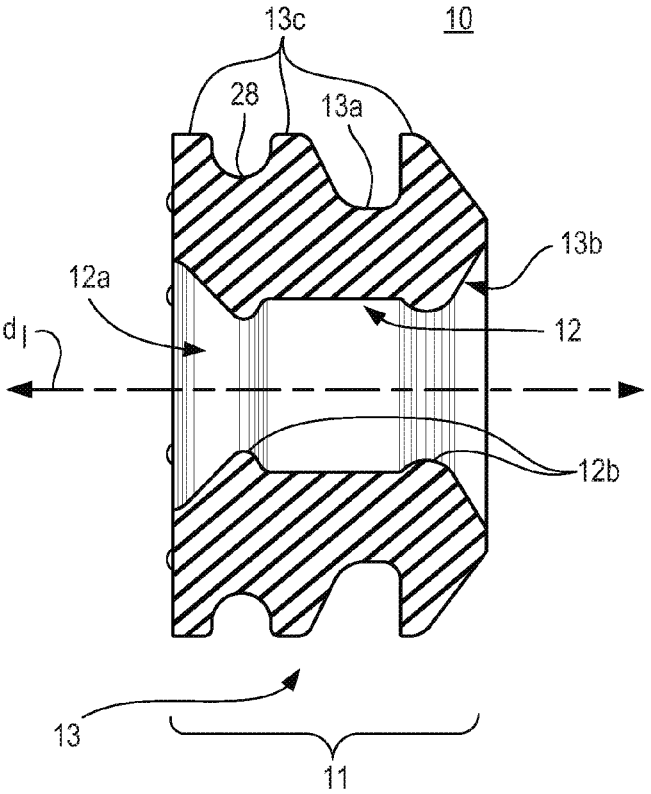
FIG. 2B is a cross-sectional view of the septum device of FIG. 2A according to an example.
Figure 2C:
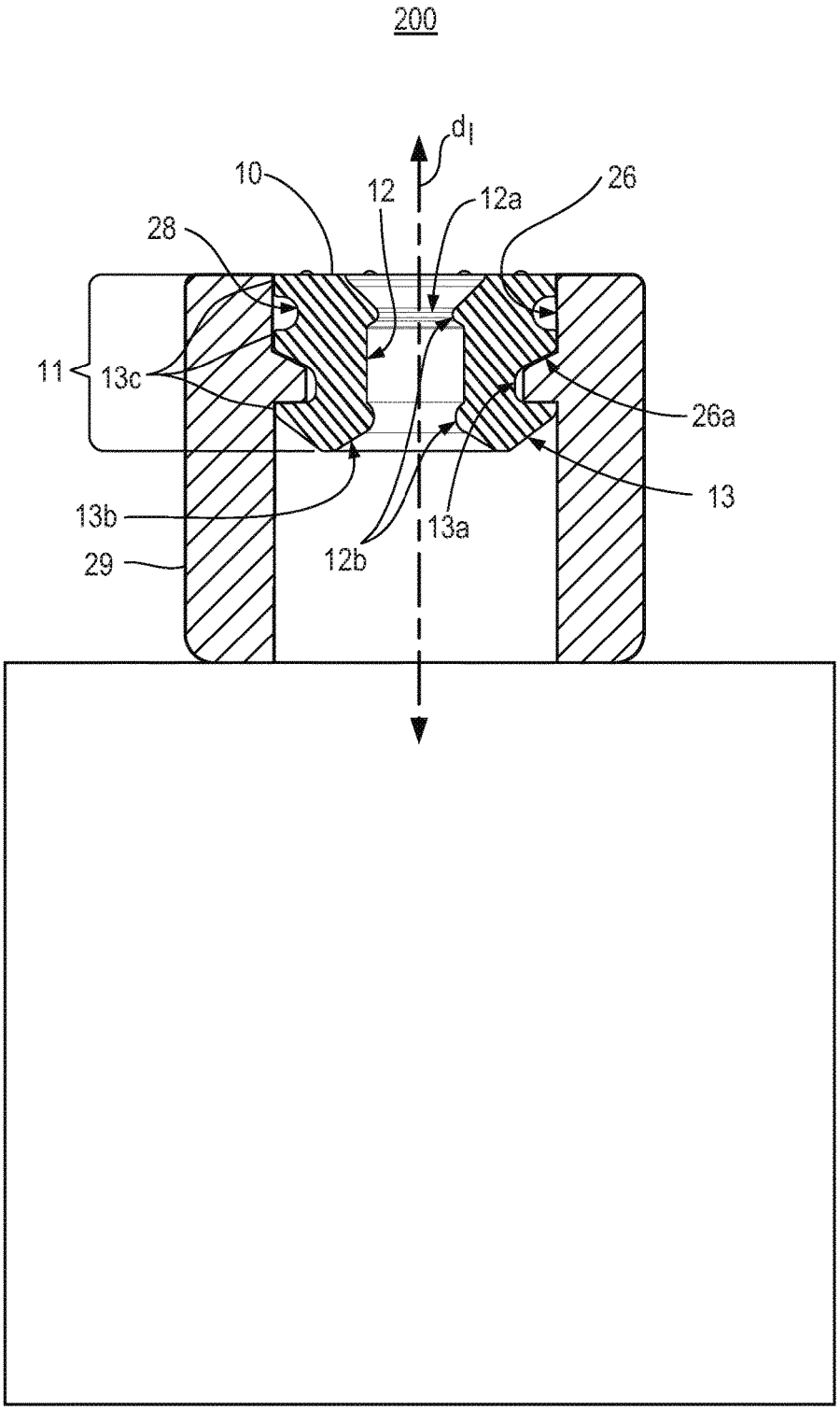
FIG. 2C is a perspective view of the septum device of FIG. 1 in an installed state in a fluid interconnect unit of a fluid supply device according to an example.

FIG. 1 is a block diagram illustrating a septum device according to an example. FIG. 2A is a perspective view of the septum device in an uninstalled state according to an example. FIG. 2B is a cross-sectional view of the septum device of FIG. 2A according to an example. FIG. 2C is a perspective view of the septum device in an installed state in a fluid interconnect unit of a fluid supply device according to an example. The septum device 10 may be usable with a fluid interconnect unit 29 of a fluid supply device 200. Referring to FIGS. 1-2C, in some examples, the septum device 10 includes a resilient main body 11 to be inserted into the fluid interconnect unit 29 of the fluid supply device 200 in an installed state as illustrated in FIG. 2C. For example, the resilient main body 11 will enable the septum device 10 to be manually inserted and press-fit into the fluid interconnect unit 29. In some examples, the septum device 10 may include rubber, and the like.

Figure 4A:
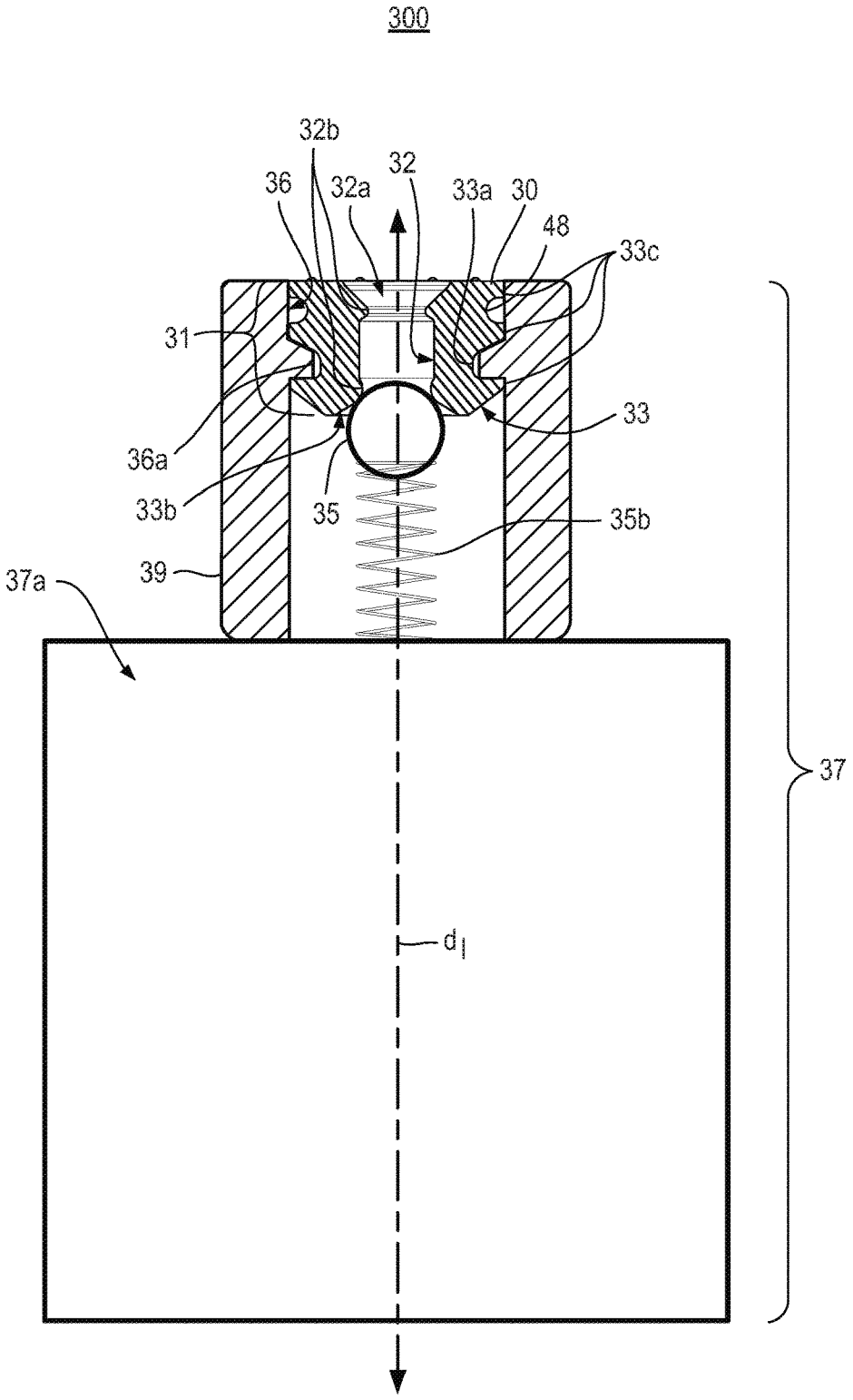
FIG. 4A is the fluid supply device of FIG. 3 in a fluid supply state according to an example.

Referring to FIGS. 1-2C, in some examples, the resilient main body 11 includes an interior septum surface 12 and an exterior septum surface 13. In some examples, the resilient main body 11 may be a unitary member. The interior septum surface 12 forms a longitudinal opening 12*a* to removably receive a fluid extraction member 401 to selectively extract fluid from the fluid supply device 200 in a fluid supply state. The fluid supply state, for example, is a state in which a fluid extraction member 401 is inserted into the septum device 10 to extract fluid from the fluid supply device 200. For example, the fluid extraction member 401 (FIG. 4A) may be a needle from an image forming apparatus 400 to extract fluid such as ink from the fluid supply device 200 as illustrated in FIG. 4A. That is, the needle may have an inlet on a side portion thereof and a passage therein to pass the ink therethrough. In some examples, the fluid supply device 200 may be an ink cartridge such as a removable ink cartridge.

Referring to FIGS. 1-2C, the interior septum surface 12 includes interior engagement members 12*b* extending toward the opening 12*a* and spaced apart from each other in a longitudinal direction $d_l$. The exterior septum surface 13 includes a first concave receiving portion 13*a*, a second concave receiving portion 13*b* and exterior engagement members 13*c*. The second concave receiving portion 13*b* may be adjacent to the opening 12*a* to receive a stopper 35 (FIG. 4B) of the fluid interconnect unit 29 in a fluid retention state. The fluid retention state, for example, is a state in which fluid is prevented from leaving the fluid supply device 200 through the opening 12*a* and/or fluid interconnect unit 29. The exterior engagement members 13*c* extend away from the opening 12*a* and are spaced apart from each other in the longitudinal direction $d_l$ to engage an interior interconnect surface 26 of the fluid interconnect unit 29 (FIG. 2C). The first concave receiving portion 13*a* is disposed between the exterior engagement members 13*c* in the longitudinal direction $d_l$ to receive a locking member 26*a* disposed on the interior interconnect surface 26 (FIG. 2C).

Referring to FIG. 2A, in some examples, the first concave receiving portion 13*a* may be disposed between the interior engagement members 12*b* in the longitudinal direction $d_l$. The first concave receiving portion 13*a* may include a radial shape and extend around a cross-section of the exterior septum surface 13 traverse to the longitudinal direction $d_l$ to receive the locking member 26*a* in response to insertion of the resilient main body 11 into the fluid interconnect unit 29 (FIG. 2B). For example, generally the radial shape of the first concave receiving portion 13*a* may evenly distribute force around the engaging locking features and/or /surfaces. Generally, insertion and engagement of the resilient main body 11 into the fluid interconnect unit 29 may evenly displace the resilient main body 11 in a radial direction while increasing and/or maintaining respective seals and locking of the resilient main body 11 in the fluid interconnect unit 29.

In examples, the first concave receiving portion 13*a* having a radial shape enables a variety of orientations of the resilient main body 11 to attain locking and sealing of the resilient main body 11 and the fluid interconnect unit 29. The interior engagement members 12*b* may include a convex radial shape and extend around a cross-section of the interior septum surface 12 traverse to the longitudinal direction $d_l$ to engage the fluid extraction member 401 to form a fluid-tight seal therebetween in response to the opening 12*a* receiving the fluid extraction member 401.

Referring to FIG. 2A, in some examples, the exterior engagement members 13*c* may include a convex radial shape and extend around a cross-section of the exterior septum surface 13 traverse to the longitudinal direction $d_l$ to engage the interior interconnect surface 26 to form a fluid-tight seal therebetween in response to insertion of the resilient main body 11 into the fluid interconnect unit 29. The exterior septum surface 13 may also include a recess portion 28 disposed between the exterior engagement members 13*c*. The recess portion 28 may include a concave radial shape and extend around a cross-section of the exterior septum surface 13 traverse to the longitudinal direction $d_l$ to allow a range of movement of at least one of the exterior engagement members 13*c* adjacent thereto during insertion of the resilient main body 11 into the fluid interconnect unit 29. The recess portion 28 may also reduce the surface area of the exterior septum surface 13 to contact the interior interconnect surface 26 of the fluid interconnect unit 29.

Figure 3:
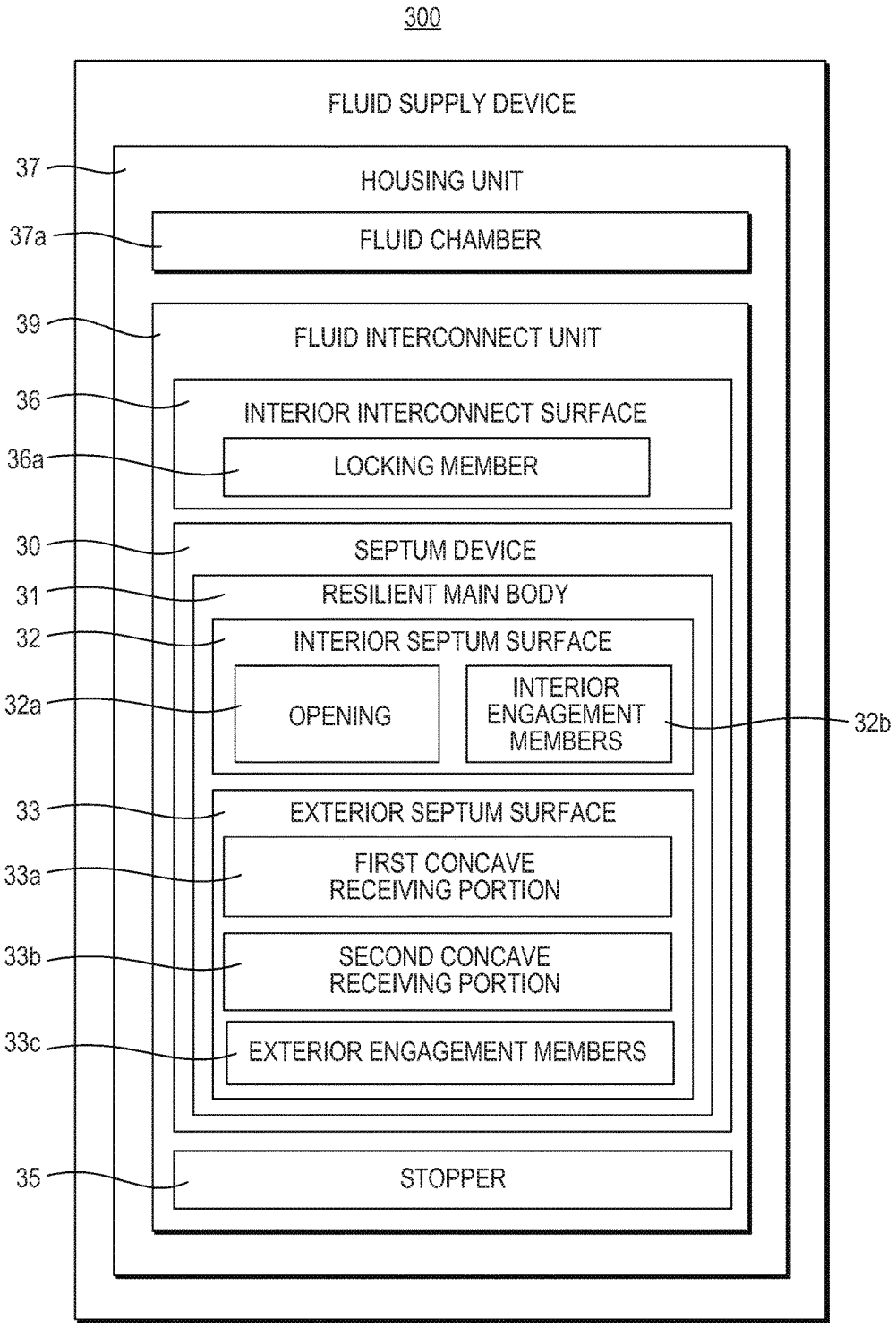
FIG. 3 is a block diagram illustrating a fluid supply device according to an example.
Figure 4B:
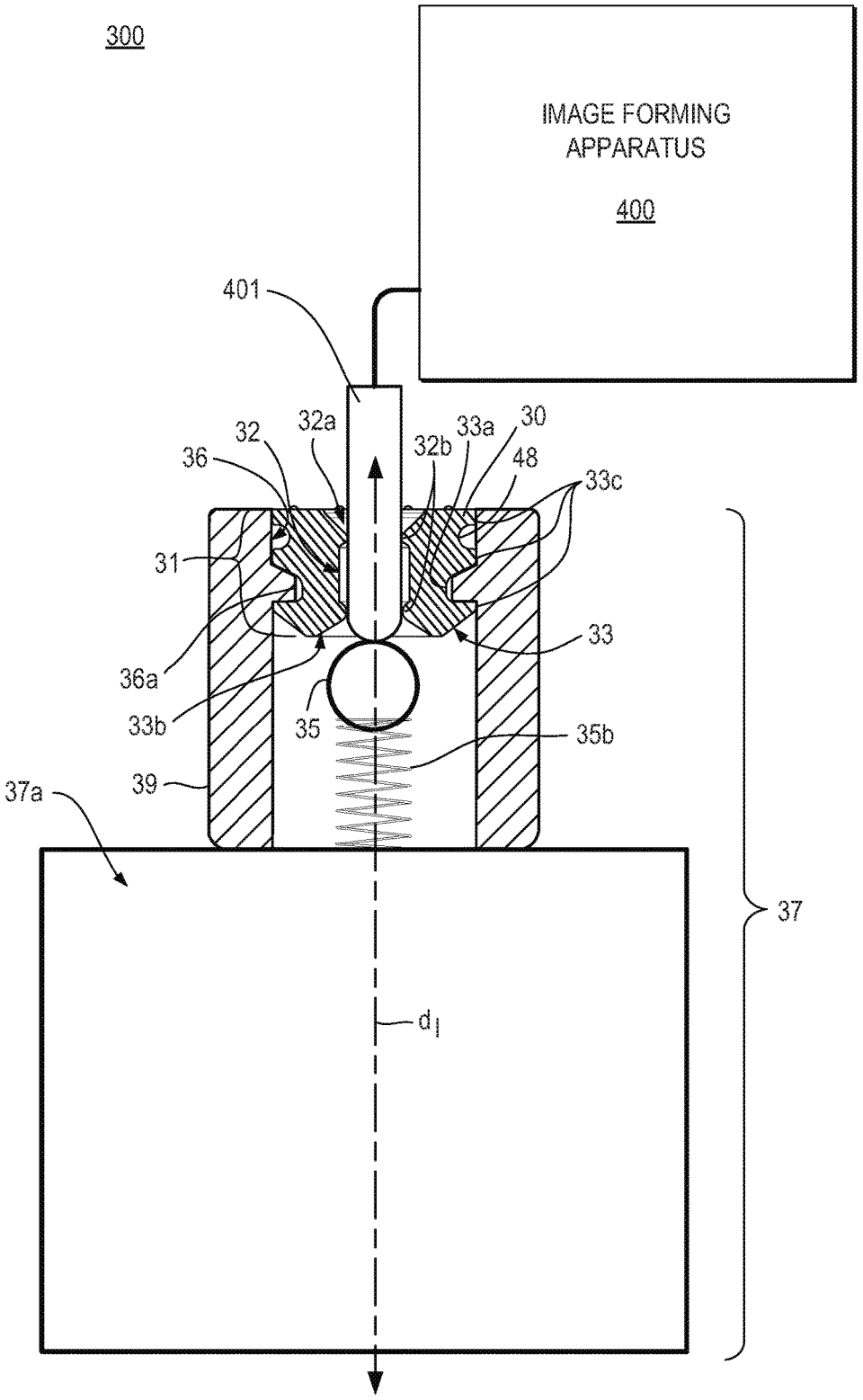
FIG. 4B is the fluid supply device of FIG. 3 in a fluid retention state according to an example.

FIG. 3 is a block diagram illustrating a fluid supply device according to an example. FIG. 4A is the fluid supply device of FIG. 3 in a fluid supply state according to an example. FIG. 4B is the fluid supply device of FIG. 3 in a fluid retention state according to an example. The fluid supply device 300 may be usable with an image forming apparatus 400 having a fluid extraction member 401. Referring to FIGS. 3-4B, the fluid supply device 300 includes a housing unit 37 including a fluid chamber 37*a* and a fluid interconnect unit 39. The fluid chamber 37*a* is disposed in the housing unit 37 to store fluid therein. For example, the fluid may be ink. The fluid interconnect unit 39 includes an interior interconnect surface 36, a septum device 30 and a stopper 35.

The interior interconnect surface 36 includes a locking member 36*a* to lock the septum device 30 in the fluid interconnect unit 39 in the installed state. The septum device 30 removably engages the interior interconnect surface 36. In a fluid supply state, the fluid interconnect unit 39 engages the fluid extraction member 401 of the image forming apparatus 400 to selectively supply the fluid from the fluid chamber 37*a* to the image forming apparatus 400 as illustrated in FIG. 4A. In some examples, the fluid extraction unit 28 may be a needle as previously disclosed, and the like, and the image forming apparatus 400 may be an inkjet printer, and the like.

Referring to FIGS. 3-4B, the septum device 30 includes a resilient main body 31 including an interior septum surface 32 and an exterior septum surface 33. The resilient main body 31 may be rubber, and the like. In some examples, the resilient main body 31 may be a unitary member. The interior septum surface 32 forms a longitudinal opening 32*a* to removably receive the fluid extraction member 401 in the fluid supply state. In a fluid retention state, the exterior septum surface 33 includes a second concave receiving portion 33*b* adjacent to the opening 32*a* to selectively receive the stopper 35 as illustrated in FIG. 4B. The stopper 35 stops the fluid in the fluid chamber 37*a* from leaving the fluid supply device 300 through the opening 32*a* and/or fluid interconnect unit 39. For example, the stopper 35 may engage the second concave receiving portion 33*b* when the fluid supply device 300 is being shipped and/or the fluid supply device 300 is not in the fluid supply state. The stopper 35 may be in a form of a stopper ball urged toward the second concave receiving portion 33*b* by a spring 35*b*.

Referring to FIGS. 3-4B, the interior septum surface 32 includes interior engagement members 32*b* extending toward the opening 32*a* and spaced apart from each other in a longitudinal direction $d_l$. The interior engagement members 32*b* may press against the fluid extraction member 401 inserted into the opening 32*a* to form a fluid-tight seal therebetween. The exterior septum surface 33 may also include exterior engagement members 33*c* and a first concave receiving portion 33*a*. The exterior engagement members 33*c* extend away from the opening 32*a* and are spaced apart from each other in the longitudinal direction $d_l$ to engage the interior interconnect surface 36 to form a fluid-type seal therebetween. The first concave receiving portion 33*a* is disposed between the exterior engagement members 33*c* in the longitudinal direction $d_l$ to receive the locking member 36*a*. Thus, the locking member 36*a* engages the first concave receiving portion 33*a* to lock the septum device 30 in the fluid interconnect unit 39 in the installed state.

Referring to FIG. 4A, in some examples, the first concave receiving portion 33*a* may be disposed between the interior engagement members 32*b* in the longitudinal direction $d_l$. The first concave receiving portion 33*a* may include a radial shape and extend around a cross-section of the exterior septum surface 33 traverse to the longitudinal direction $d_l$. For example, the radial shape of the first concave receiving portion 33*a* may evenly distribute force around the engaging locking features and/or /surfaces. Generally, insertion and engagement of the resilient main body 31 into the fluid interconnect unit 39 may evenly displace the resilient main body 31 in a radial direction while increasing and/or maintaining respective seals and locking of the resilient main body 31 in the fluid interconnect unit 39. In examples, the first concave receiving portion 33*a* having a radial shape enables a variety of orientations of the resilient main body 31 to attain locking and sealing of the resilient main body 31 and the fluid interconnect unit 39.

Referring to FIG. 4A, in examples, the interior engagement members 32*b* may extend around a cross-section of the interior septum surface 32 traverse to the longitudinal direction $d_l$ to engage the fluid extraction member 401 to form a fluid-tight seal therebetween in response to the opening 32*a* receiving the fluid extraction member 401 (FIG. 4A). In the fluid supply state, the fluid extraction member 401 is inserted into the hole 32*a* of the septum device 30 and pushes the stopper 35 away from the second concave receiving portion 33*b* to allow fluid to flow from the fluid chamber 37*a* through the fluid extraction member 401 to the image forming apparatus 400.

Referring to FIG. 4A, the exterior engagement members 33*c* may extend around a cross-section of the exterior septum surface 33 traverse to the longitudinal direction $d_l$ to engage the interior interconnect surface 36 to form a fluid-tight seal therebetween. The exterior septum surface 33 may also include a recess portion 48 disposed between the exterior engagement members 33*c*. The recess portion 48 may extend around a cross-section of the exterior septum surface 33 traverse to the longitudinal direction $d_l$ to form a gap with the interior interconnect surface 36. That is, the recess portion 48 may also reduce the surface area of the exterior septum surface 33 to contact the interior interconnect surface 36 of the fluid interconnect unit 39. In some examples, the gap may reduce the axial force needed for manual insertion of the septum device 30 into the fluid interconnect unit 39.

Referring to FIG. 4A, in some examples, the exterior engagement members 33*c* and the recess portion 48 disposed therebetween may reduce an amount of axial force for manual insertion of the septum device 30 into the fluid supply device 300. For example, the amount of axial force to insert the septum device 30 into the fluid interconnect unit 39 may be reduced due to a range of movement of the exterior engagement members 33*c* and reduced surface contact between the septum device 30 and the interior interconnect surface 36 due to the recess portion 48. Further, the exterior engagements members 33*c* form a fluid-tight seal with the interior interconnect surface 36 of the fluid supply device 300 in the installed state (FIGS. 4A and 4B), the interior engagement members 32*b* form a fluid-tight seal with the exterior surface of the fluid extraction member 401 in the fluid supply state (FIG. 4A), and second concave receiving portion 33*b* forms a fluid-tight seal with the stopper 35 in the fluid retention state (FIG. 4B).

In some examples, forces due to engagement of the exterior engagement members 33*c* with the interior interconnect surface 36 may reinforce the fluid-tight seal between the interior engagement members 32*a* and the fluid extraction member 401. In some examples, forces due to engagement of the interior engagement members 32*b* with the fluid extraction member 401 may reinforce the fluid-tight seal between the exterior engagement members 33*c* and the interior interconnect surface 36. For example, the exterior engagement members 33*c* and the interior engagement members 32*a* transfer forces from the septum device 30 to aid the fluid-tight seals and the locking of the septum device 30 within the fluid interconnect unit 39.

Figure 5:
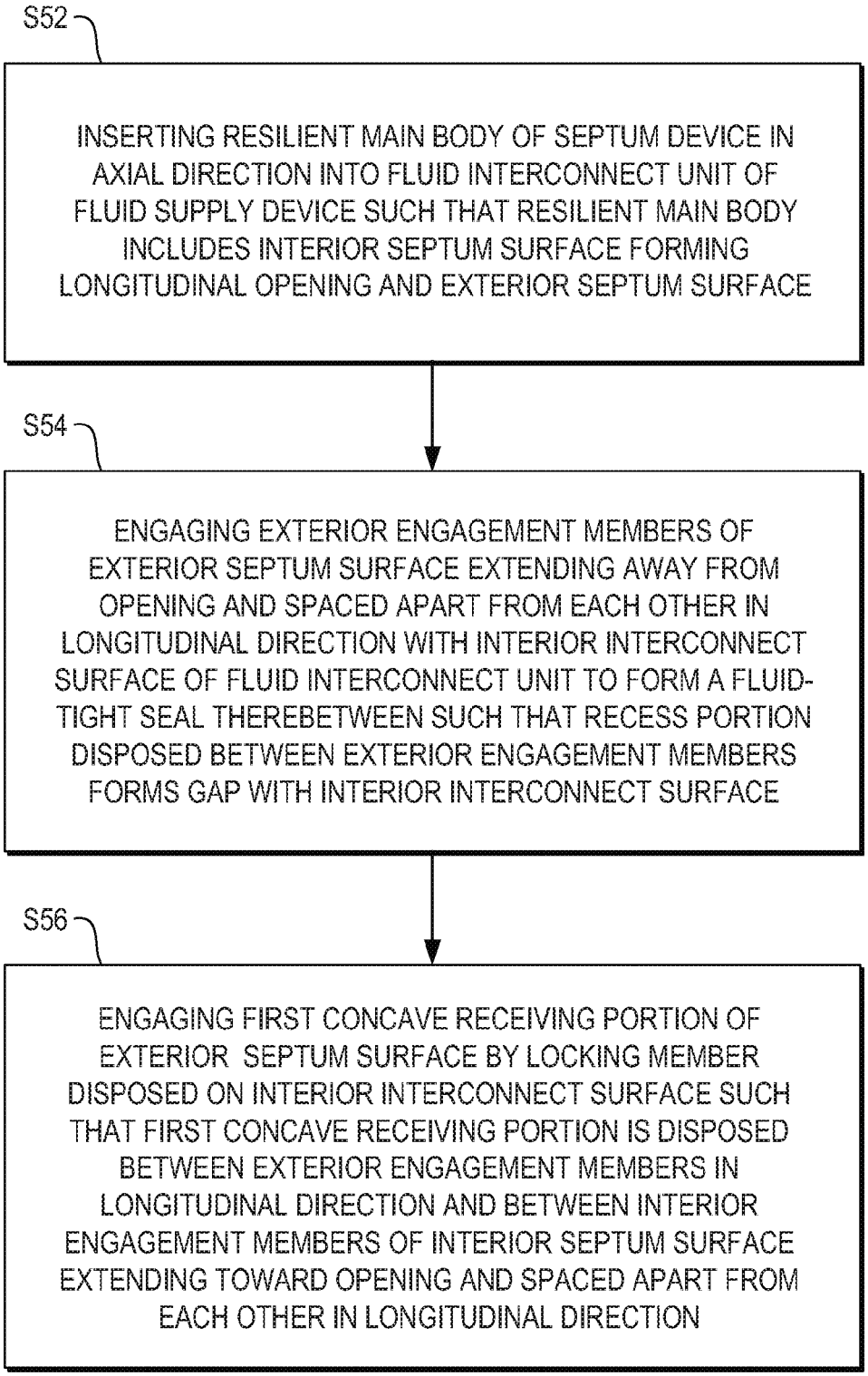
FIG. 5 is a flowchart illustrating a method of inserting a septum device into a fluid interconnect unit of a fluid supply device according to an example.

FIG. 5 is a flowchart illustrating a method of inserting a septum device into a fluid interconnect unit of a fluid supply device according to an example. In block S52, a resilient main body of the septum device is inserted in an axial direction into the fluid interconnect unit of the fluid supply device. The resilient main body includes an interior septum surface forming a longitudinal opening and an exterior septum surface. In some examples, the recess portion may allow a range of at least one of the engagement members adjacent to the recess portion such that the recess portion includes a concave-radial shape and extends around a cross-section of the exterior septum surface traverse to the longitudinal direction. In block S54, exterior engagement members of the exterior septum surface extending away from the opening and spaced apart from each other in the longitudinal direction engage an interior interconnect surface of the fluid interconnect unit to form a fluid-tight seal therebetween. A recess portion disposed between the exterior engagement members forms a gap with the interior interconnect surface. For example, the exterior engagement members may extend around a cross-section of the exterior septum surface traverse to the longitudinal direction to engage the interior interconnect surface to form a fluid-tight seal therebetween.

In block S56, a first concave receiving portion of the exterior septum surface is engaged by a locking member disposed on the interior interconnect surface. The first concave receiving portion may be disposed between the exterior engagement members in the longitudinal direction and between interior engagement members of the interior septum surface extending toward the opening and spaced apart from each other in the longitudinal direction. In some examples, the first concave receiving portion may include a radial shape and extend around a cross-section of the exterior septum surface traverse to the longitudinal direction.

The method may also include a fluid extraction member being received by the opening in a fluid supply state. The interior engagement members may extend around a cross-section of the interior septum surface traverse to the longitudinal direction to engage the fluid extraction member to form a fluid-tight seal therebetween. The method may also include a stopper of the fluid interconnect unit being received by a second concave receiving portion adjacent to the opening in a fluid retention state to stop fluid from leaving the fluid supply unit through the opening thereof.

It is to be understood that the flowchart of FIG. 5 illustrates an architecture, functionality, and operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be scrambled relative to the order illustrated. Also, two or more blocks illustrated in succession in FIG. 5 may be executed concurrently or with partial concurrence. All such variations are within the scope of the present disclosure.

An example septum device usable with a fluid interconnect unit of a fluid supply device, the septum device includes a resilient main body to insert into the fluid interconnect unit of the fluid supply device, the resilient main body including an interior septum surface forming a longitudinal opening to removably receive a fluid extraction member to selectively extract fluid from the fluid supply device in a fluid supply state and an exterior septum surface including a second concave receiving portion adjacent to the opening to receive a stopper of the fluid interconnect unit in a fluid retention state; the interior septum surface including interior engagement members extending toward the opening and spaced apart from each other in a longitudinal direction; and the exterior septum surface including exterior engagement members extending away from the opening and spaced apart from each other in the longitudinal direction to engage an interior interconnect surface of the fluid interconnect unit, and a first concave receiving portion disposed between the exterior engagement members in the longitudinal direction to receive a locking member disposed on the interior interconnect surface.

In some examples, the first concave receiving portion is disposed between the interior engagement members in the longitudinal direction. In some examples, the first concave receiving portion comprises a radial shape and extends around a cross-section of the exterior septum surface traverse to the longitudinal direction to receive the locking member in response to insertion of the resilient main body into the fluid interconnect unit. In some examples, the interior engagement members comprise a convex radial shape and extend around a cross-section of the interior septum surface traverse to the longitudinal direction to engage the fluid extraction member to form a fluid-tight seal therebetween in response to the opening receiving the fluid extraction member.

In some examples, the exterior engagement members comprise a convex radial shape and extend around a cross-section of the exterior septum surface traverse to the longitudinal direction to engage the interior interconnect surface to form a fluid-tight seal therebetween in response to insertion of the resilient main body into the fluid interconnect unit. In some examples, the exterior septum surface further comprises: a recess portion disposed between the exterior engagement members, the recess portion including a concave radial shape and extends around a cross-section of the exterior septum surface traverse to the longitudinal direction to allow movement of at least one of the engagement members adjacent thereto during insertion of the resilient main body into the fluid interconnect unit.

An example fluid supply device usable with an image forming apparatus having a fluid extraction member, the fluid supply device comprising: a housing unit including a fluid chamber therein to store fluid and a fluid interconnect unit to engage the fluid extraction member in a fluid supply state to selectively supply the fluid from the fluid chamber to the image forming apparatus, the fluid interconnect unit including an interior interconnect surface having a locking member, a septum device removably engaged with the interior interconnect surface, and a stopper; the septum device of the fluid interconnect unit, including: a resilient main body including an interior septum surface forming a longitudinal opening to removably receive the fluid extraction member in the fluid supply state and an exterior septum surface including a second concave receiving portion adjacent to the opening to selectively receive the stopper in a fluid retention state; the interior septum surface including interior engagement members extending toward the opening and spaced apart from each other in a longitudinal direction; and the exterior septum surface further including exterior engagement members extending away from the opening and spaced apart from each other in the longitudinal direction to engage the interior interconnect surface to form a fluid-type seal therebetween, and a first concave receiving portion disposed between the exterior engagement members in the longitudinal direction to receive the locking member.

In some examples, the first concave receiving portion is disposed between the interior engagement members in the longitudinal direction. In some examples, the first concave receiving portion comprises a radial shape and extends around a cross-section of the exterior septum surface traverse to the longitudinal direction. In some examples, the interior engagement members extend around a cross-section of the interior septum surface traverse to the longitudinal direction to engage the fluid extraction member to form a fluid-tight seal therebetween in response to the opening receiving the fluid extraction member. In some examples, the exterior engagement members extend around a cross-section of the exterior septum surface traverse to the longitudinal direction to engage the interior interconnect surface to form a fluid-tight seal therebetween. In some examples, the exterior septum surface further comprises: a recess portion disposed between the exterior engagement members extending around a cross-section of the exterior septum surface traverse to the longitudinal direction to form a gap with the interior interconnect surface.

An example method of inserting a septum device into a fluid interconnect unit of a fluid supply device, the method comprising: inserting a resilient main body of the septum device in an axial direction into the fluid interconnect unit of the fluid supply device such that the resilient main body includes an interior septum surface forming a longitudinal opening and an exterior septum surface; engaging exterior engagement members of the exterior septum surface extending away from the opening and spaced apart from each other in the longitudinal direction with an interior interconnect surface of the fluid interconnect unit to form a fluid-tight seal therebetween such that a recess portion disposed between the exterior engagement members forms a gap with the interior interconnect surface; and engaging a first concave receiving portion of the exterior septum surface by a locking member disposed on the interior interconnect surface such that the first concave receiving portion is disposed between the exterior engagement members in the longitudinal direction and between interior engagement members of the interior septum surface extending toward the opening and spaced apart from each other in the longitudinal direction.

In some examples, the method includes receiving a fluid extraction member by the opening in a fluid supply state such that the interior engagement members extending around a cross-section of the interior septum surface traverse to the longitudinal direction engage the fluid extraction member to form a fluid-tight seal therebetween. In some examples, the method includes receiving a stopper of the fluid interconnect unit by a second concave receiving portion adjacent to the opening in a fluid retention state to stop fluid from leaving the fluid supply unit through the opening thereof.

An example septum device usable with a fluid interconnect unit of a fluid supply device, the septum device includes a body to be inserted into the fluid interconnect unit, the body including: an interior septum surface including first and second inwardly extending protrusions defining an aperture, the first protrusion spaced from the second protrusion, when the aperture removably receives a fluid extraction member to selectively extract fluid from the fluid supply device, the fluid extraction member engages the first and second protrusions to urge the body outwardly, a first end of the aperture including an opening to receive the fluid extraction member, a second end of the aperture including a seat to be engaged by a fluid control member to control fluid flow through the aperture; and an exterior surface including: a third protrusion including a tapered surface on a first side of the third protrusion and a locking surface on a second side of the third protrusion, the tapered surface extending toward and contiguous with an end surface of the body defining the seat, the locking surface at least partially defining a first groove, the third protrusion to form a connection with the fluid interconnect unit by the first groove receiving a locking member of the fluid interconnect unit after the tapered surface has engaged and moved past the locking member, the third protrusion being positioned relative to the first protrusion to increase sealing engagement at the connection when the fluid extraction member engages the first protrusion and urges the body outwardly; and a second groove that reduces an amount of surface interaction between the body and the fluid interconnect unit when the body is inserted into the fluid interconnect unit to reduce an axial force imparted on the body when the body is inserted into the fluid interconnect unit.

In some examples, the second groove includes a radial shape and extends around a cross-section of the exterior surface transverse to a longitudinal axis of the body. In some examples, the first and second protrusions have a convex radial shape and extend around a cross-section of the aperture transverse to a longitudinal axis of the body to engage the fluid extraction member to form a fluid-tight seal therebetween when the aperture receives the fluid extraction member. In some examples, the second groove is defined by fourth and fifth protrusions. In some examples, the groove includes a concave radial shape. In some examples, the first groove includes a concave radially-shaped portion to receive a fourth protrusion of the fluid interconnect unit.

An example fluid supply device usable with an image forming apparatus having a fluid extraction member, the fluid supply device comprising: a housing including: a fluid chamber to store fluid; and a fluid interconnect unit to receive the fluid extraction member at an opening of the fluid interconnect unit to selectively supply the fluid from the fluid chamber to the image forming apparatus, the fluid interconnect unit including an interior interconnect surface; a septum removably engaged with the interior interconnect surface, a body of the septum, including: an aperture defined by first and second inwardly extending protrusions, the first protrusion spaced from the second protrusion, the fluid extraction member engages the first and second protrusions to urge the body outwardly when the aperture removably receives the fluid extraction member, and an exterior surface including a tapered surface and a groove, the tapered surface extending toward and contiguous with an insertion end of the septum, the insertion end of the septum defining a seat, the seat to be engaged by a fluid flow control member to control fluid flow through the aperture, the groove to reduce an amount of surface interaction between the body and the fluid interconnect unit when the body is inserted into the fluid interconnect unit and to reduce an axial force needed to insert the body into the fluid interconnect unit, a first diameter of the interior interconnect surface adjacent the opening being greater than a second diameter of the groove to deter the interior interconnect surface from being received within the groove when the body is inserted into the fluid interconnect unit.

In some examples, the groove has a radial shape and extends around a cross-section of the exterior surface transverse to a longitudinal axis of the body. In some examples, the first and second protrusions extend around a cross-section of the aperture transverse to a longitudinal axis of the body to engage the fluid extraction member to form a fluid-tight seal therebetween when the aperture receives the fluid extraction member. In some examples, the groove is defined by exterior engagement members extending around a cross-section of the exterior surface transverse to a longitudinal axis of the body to form a gap with the interior interconnect surface.

An example septum device usable with a fluid interconnect unit of a fluid supply device, the septum device comprising: a resilient main body to be inserted into the fluid interconnect unit of the fluid supply device, the resilient main body including an interior septum surface forming a longitudinal opening to removably receive a fluid extraction member to selectively extract fluid from the fluid supply device in a fluid supply state and an exterior septum surface including a seat adjacent to the opening to be engaged by a plug of the fluid interconnect unit in a fluid retention state; the interior septum surface including first and second inwardly extending protrusions that extend into the opening, the first and second protrusions being spaced apart from each other along a longitudinal axis of the resilient main body; and the exterior septum surface including: a third protrusion including a tapered surface on a first side of the third protrusion and a locking surface on a second side of the third protrusion, the tapered surface extending toward and being contiguous with an end surface of the resilient main body defining the seat, the locking surface at least partially defining a first groove, the third protrusion to form a connection with the fluid interconnect unit when the first groove receives a locking member of the fluid interconnect unit, the third protrusion being positioned relative to the first protrusion to increase sealing engagement at the connection when the fluid extraction member engages the first protrusion; and a second groove that reduces an amount of surface interaction between the body and the fluid interconnect unit when the body is inserted into the fluid interconnect unit to thereby reduce an axial force employed to insert the body into the fluid interconnect unit.

In some examples, the second groove includes a radial shape and extends around a cross-section of the exterior septum surface transverse to the longitudinal axis. In some examples, the first and second protrusions include a convex radial shape and extend around a cross-section of the interior septum surface transverse to the longitudinal axis to engage the fluid extraction member to form a fluid-tight seal therebetween when the opening removably receives the fluid extraction member. In some examples, the first groove includes a concave radially-shaped portion to receive a fourth protrusion of the fluid interconnect unit.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A septum for use with a fluid supply device, the septum comprising:

a body having an aperture extending between a first end and a second end of the body, the body including:

a first exterior engagement surface, a second exterior engagement surface, and a groove positioned between the first and second exterior engagement surfaces, the first exterior engagement surface at the first end of the body, the groove to receive a locking member of the fluid supply device when the septum is inserted into the fluid supply device; and an interior surface including a first protrusion adjacent the first end of the body and a second protrusion adjacent the second end of the body extending from the interior surface into the aperture, the interior surface having a straight profile between the first protrusion and the second protrusion, the straight profile having a longitudinal axis that is coaxially aligned with a longitudinal axis of the aperture, at least one of the first protrusion or the second protrusion to rotate at least one of the first exterior engagement surface or the second exterior engagement surface toward the locking member in response to an extraction member engaging the at least one of the first protrusion or the second protrusion.

2. The septum of claim 1, further including a tapered surface between the first exterior engagement surface and the first end of the body, the tapered surface to facilitate insertion of the septum into the fluid supply device.

3. The septum of claim 1, wherein the body includes a seat to receive a plug to control fluid flow through the aperture.

4. The septum of claim 3, wherein the first protrusion at least partially defines the seat.

5. The septum of claim 3, wherein the first protrusion is contiguous with the seat.

6. The septum of claim 1, wherein a first plane passing through a first central portion of the first protrusion is substantially parallel and laterally offset relative to a second plane that passes through a second central portion of the groove to enable the first protrusion to urge the first exterior engagement surface toward the locking member in response to the extraction member engaging the first protrusion.

7. The septum of claim 1, wherein the first exterior engagement surface and the second exterior engagement surface entrap the locking member of the fluid supply device in the groove when the septum is coupled to the fluid supply device.

8. The septum of claim 1, wherein the exterior surface of the body includes an exterior recess positioned between the second exterior engagement surface and a third exterior engagement surface, the exterior recess to reduce an axial force needed to insert the septum into the fluid supply device.

9. The septum of claim 1, wherein the first protrusion located between the first end of the body and the first exterior engagement surface, and the second protrusion located between the second exterior engaging surface and the second end of the body.

10. An apparatus, comprising:

a reservoir;

a fluid supply device including:

an inner surface defining an opening in fluid communication with the reservoir; and, a locking member extending from the inner surface at the opening; and a septum insertable into the opening of the fluid supply device, the septum including:

a first end;

a second end opposite the first end;

first, second and third exterior engagement surfaces to frictionally engage the fluid supply device, a groove between the first and second exterior engagement surfaces, an exterior recess between the third exterior engagement surface and the second exterior engagement surface, the groove to receive the locking member of the fluid supply device when the septum is inserted into the opening of the fluid supply device; and an interior surface between the first end and the second end, the septum including a first protrusion and a second protrusion extending from the interior surface towards a longitudinal axis of the septum, the interior surface defining a flat wall at a central location of the interior surface between the first protrusion and the second protrusion, the first protrusion positioned between the first exterior engagement surface and the first end, and the second protrusion aligned with the exterior recess and positioned between the second exterior engagement surface and the third exterior engagement surface, the first and second protrusions to urge the first and second exterior engagement surfaces toward the locking member in response to an extraction member engaging the first and second protrusions.

11. The apparatus of claim 10, wherein a first plane that passes through a first central portion of the first protrusion is substantially parallel and offset relative to a second plane that passes through a second central portion of the groove to enable the first protrusion to urge the first exterior engagement surface toward the locking member in response to the extraction member engaging the first protrusion.

12. The apparatus of claim 10, wherein a cross-section of the locking member corresponds to a cross-section of the groove.

13. The septum of claim 10, wherein a peripheral edge of the first, second and third exterior engagement surfaces defines an outermost diameter of the septum.

14. The septum of claim 10, wherein the opening of the fluid supply device has a straight edge between an end of the opening and an end of the fluid supply device.

15. The septum of claim 10, wherein the exterior recess is to reduce an amount of contact surface area between the septum and the inner surface of the fluid supply device to reduce an axial force needed to insert the septum into the fluid supply device.

16. The septum of claim 10, wherein the interior surface includes only the first protrusion and the second protrusion extending from the interior surface.

17. A septum for use with a fluid supply device, the septum comprising:

a body including:

a first end;

a second end;

an exterior including:

a first exterior engagement surface positioned adjacent the first end of the body; a second exterior engagement surface; and a third exterior engagement surface positioned adjacent the second end of the body;

a groove between the first and second exterior engagement surfaces, the groove to receive a locking member of the fluid supply device when the septum is inserted into the fluid supply device; and an interior including:

a first protrusion;

a second protrusion spaced from the first protrusion; and a straight wall positioned between the first protrusion and the second protrusion, the straight wall being parallel relative to a longitudinal axis of the body, the straight wall to connect the first and second protrusions, the first protrusion to rotate at least a portion of the exterior surface toward the locking member in response to an extraction member engaging the first protrusion.

18. The septum of claim 17, wherein the body includes an interior surface between the first end of the body and the second end of the body, the interior surface including a first protrusion and a second protrusion extending from the interior surface towards a longitudinal axis of an aperture of the body.

19. The septum of claim 18, wherein the first protrusion is between the first exterior engagement surface and the first end of the body, and the second protrusion is between the second exterior engagement surface and the third exterior engagement surface.

20. The septum of claim 19, wherein at least one of the first or second protrusions is to urge at least one of the first or second exterior engagement surfaces toward the locking member in response to an extraction member engaging the first and second protrusions.

21. The septum of claim 17, further including a recess between the second exterior engagement surface and the third exterior engagement surface, the recess to facilitate insertion of the septum into the fluid supply device.

* * * * *